United States Patent [19]

Knox

[11] Patent Number: 4,564,981

[45] Date of Patent: Jan. 21, 1986

[54] BUCKLE-STRAP TIEDOWN ASSEMBLY

[75] Inventor: Howard T. Knox, Simi, Calif.

[73] Assignee: ANCRA Corporation, El Segundo, Calif.

[21] Appl. No.: 624,409

[22] Filed: Jun. 25, 1984

[51] Int. Cl.[4] ..... A44B 11/12; A44B 21/00

[52] U.S. Cl. ..... 24/68 CD; 24/68 E; 24/193; 24/197

[58] Field of Search ..... 24/68 CD, 68 E, 68 R, 24/68 CT, 265 CD, 270, 271, 273, 193, 191, 170, 173

[56] References Cited

U.S. PATENT DOCUMENTS

| | | | |
|---|---|---|---|
| 519,546 | 5/1894 | McClure | 24/193 |
| 1,517,536 | 12/1924 | Cull et al. . | |
| 1,636,638 | 7/1927 | Jenkins . | |
| 2,442,266 | 5/1948 | Davis | 24/193 |
| 2,825,109 | 3/1958 | Nelson . | |
| 2,972,173 | 2/1961 | Weber | 24/171 |
| 2,997,761 | 8/1961 | Davis | 24/68 E |
| 3,060,537 | 10/1962 | Hatfield | 24/197 |
| 3,289,261 | 12/1966 | Davis | 24/193 |
| 3,349,449 | 10/1967 | Hatfield | 24/197 |
| 3,449,798 | 6/1969 | Hofmann . | |
| 3,538,553 | 11/1970 | Brucker . | |
| 4,073,317 | 2/1978 | Ellis . | |
| 4,118,833 | 10/1978 | Knox et al. | 24/68 CD |
| 4,324,022 | 4/1982 | Prete, Jr. | 24/68 CD |
| 4,414,713 | 11/1983 | Prete, Jr. | 24/193 |
| 4,464,811 | 8/1984 | Holmes | 24/68 CD |

FOREIGN PATENT DOCUMENTS

| | | | |
|---|---|---|---|
| 1268551 | 3/1972 | United Kingdom | 24/68 CD |

*Primary Examiner*—Victor N. Sakran

*Attorney, Agent, or Firm*—Edward A. Sokolski

[57] ABSTRACT

A two piece buckle has a frame member and a bale member which is pivotally supported on the frame member. The frame member includes a central elongated substantially flat piece and a pair of arm members extending from the edges of the central piece at an angle of substantially 90 degrees. These arm members have a pair of apertures formed therein which provide sockets into which the opposite ends of the bale fit. A ramp is formed directly beneath each one of these apertures to facilitate the installation of the bale member in the apertures in a snap fit. A pair of detents which are on the form of projections extending outwardly from the frame arm members are located forward of the apertures in which the bale member is pivotally supported. The bale and arm members are both resilient such that the bale member can be pivotally moved over the detents and thus positioned on either side of the detents. The central piece of the frame has a pair of slots formed therein through which a strap may be reaved in retention on the frame while a second strap is attached to the bale member. The two straps with their extreme ends suitably retained are placed over the member to be tied down with the frame in a "release" position with the bale on one side of the detents. The strap which is reaved through the slots on the frame member is then adjusted for tiedown and the frame moved to its "tension" position with the bale on the other side of the detents.

4 Claims, 6 Drawing Figures

BUCKLE-STRAP TIEDOWN ASSEMBLY

This application relates to a buckle-strap tiedown assembly and more particularly to such an assembly employing a bale member to which one strap is attached and which is pivotally supported on a frame member to which a second strap is attached, the buckle being used to tighten the strap.

Various types of buckles for tightening strap, rope and chains around a load to be restrained are described in the prior art. These include the devices described in U.S. Pat. No. 1,517,536 to Cull et al; U.S. Pat. No. 1,636,638 to Jenkins; U.S. Pat. No. 2,825,109 to Nelson; U.S. Pat. No. 3,449,789 to Hofmann; U.S. Pat. No. 3,538,553 to Brucker; U.S. Pat. No. 4,073,317 to Ellis. U.S. Pat. No. 3,538,553 describes a strap tightening lever for tightening strap around a load which employs a body section to which one end of the strap is attached and a tightening lever to which the other end of the strap is attached with tightening being achieved by virtue of pivotal motion of the body section relative to the lever wherein proturberances or detents are formed on the body section which operate with sockets formed on the lever to retain the buckle in the tensioned position.

The device of the present invention is an improvement over that of Brucker, in that it is of simpler and more ecomonical construction and yet provides the capability for effectively handling heavy loads.

It it therefore an object of this invention to provide a durable and reliable buckle assembly of economical construction capable of handling heavy loads.

It is a further object of this invention to provide a buckle assembly suitable for use in tying down cargo for transportation which is of simple construction and which is easy to operate.

Other objects of this invention will become apparent as the description proceeds in connection with the accompanying drawings of which:

Figure 1:
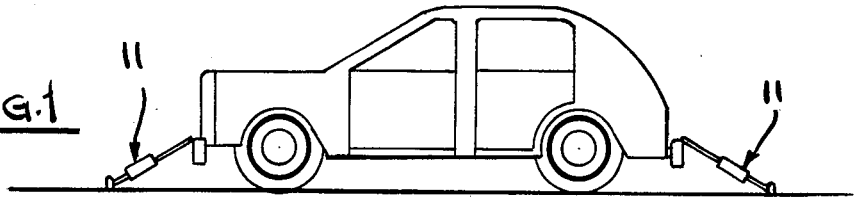
FIG. 1 is side elevational view illustrating the device of the invention being used for tying down an automobile.

Briefly described, the device of the present invention includes a frame member havng a generally flat central piece and a pair of opposite legs which extend normally from the edges of the central piece. The legs of the central piece have a pair of oppositely positioned apertures formed therein into which the ends of a bale member are resiliently fitted, the bale thus being pivotally supported on the frame. The bale is resilient so that it can be snapped into position in the aperture on the frame legs along a pair of oppositely positioned rams formed in such legs directly adjacent to the apertures. A pair of oppositely positioned detents or projections are formed on the outer walls of the legs. A first strap piece is attached to the bale member while a second strap piece is reaved through slots formed in the frame and thus adjustably secured thereto. The buckle is in a "release" position when the bale is on one side of the detents. To tension the buckle, the frame is moved over the detents to the opposite side thereof, the frame being prevented by the detents from going to the release position unless manually rotated over the detents to this position.

Referring now to the figures, frame 11 has a substantially flat central piece 11*a* and a pair of legs 11*b* and 11*c* extending normally from the opposite side edges of this central piece. Central piece 11*a* has a pair of slots 11*e* and 11*f* formed therein through which a strap member 14 is reaved. Bale member 16 is generally U-shaped and has a circular cross section, with a pair of turned in open end portions 16*a* and 16*b*. Bale member 16 is resilient such that the end portion 16*a* and 16*b* thereof can be slided along the ramps 11*i* and 11*j* formed in legs 11*b* and 11*c* respectively, these ramps being directly beneath apertures 11*g* and 11*h* respectively. The end portions 16*a* and 16*b* of the bale member thus can be slided along the ramps and snapped in position in their respective associated frame apertures in retention on the frame for pivotal motion relative thereto. Strap section 18 is fixed in position on bale 16 by stitching. Strap 14 can be adjusted insofar as its effective length is concerned with the buckle in its released position.

Figure 5:
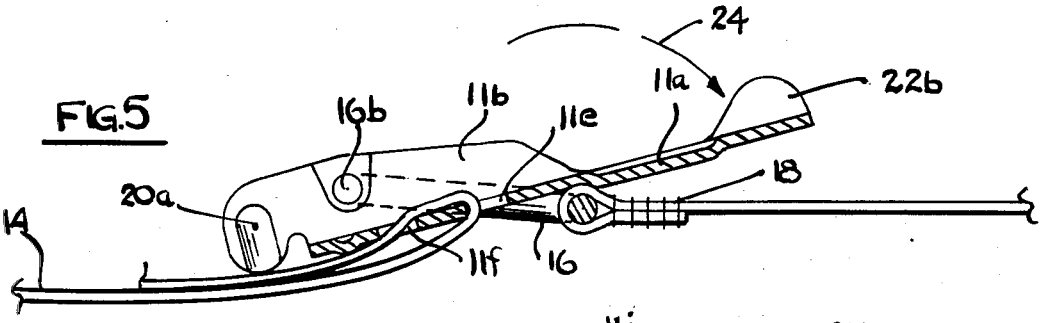
FIG. 5 is a cross-sectional view showing the preferred embodiment in the "release" position.
Figure 2:
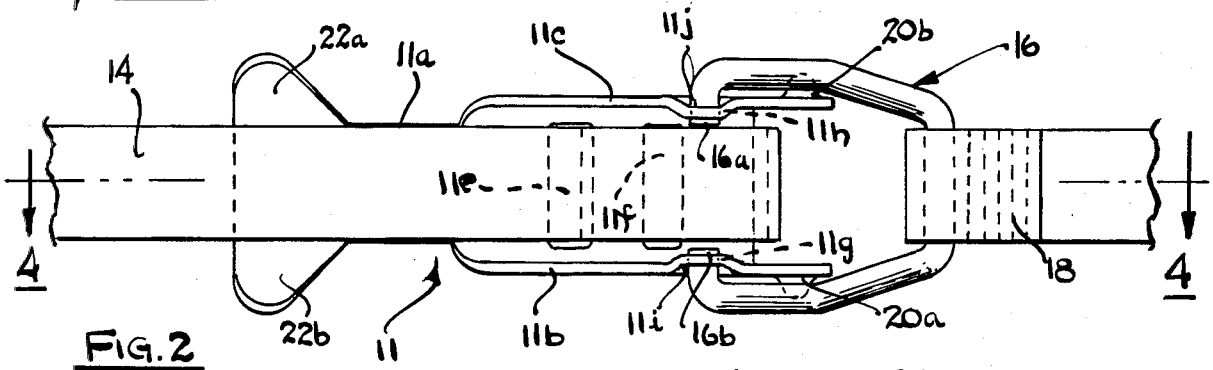
FIG. 2 is a top plan view of the preferred embodiment of the invention.
Figure 3:
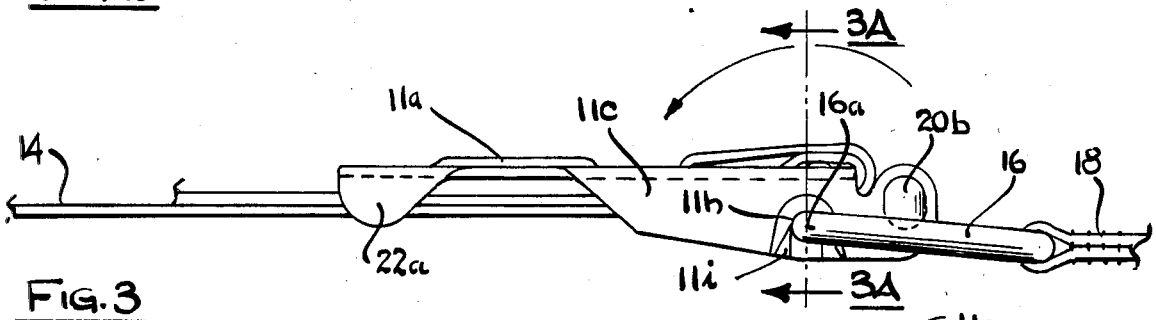
FIG. 3 is a side elevational view of the preferred embodiment.
Figure 3A:
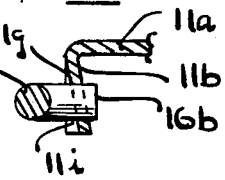
FIG. 3A is a cross-sectional view taken along the plane indicated by 3A—3A in FIG. 3.
Figure 4:
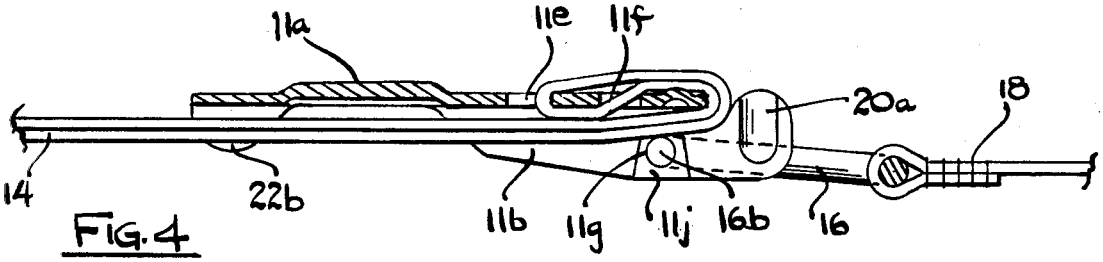
FIG. 4 is cross-sectional view taken along the plane indicated by 4—4 in FIG. 2.

Detents or proturberances 20*a* and 20*b* are formed on the outer walls of legs 11*b* and 11*c* respectively near the ends of these legs beyond the location therein of apertures 11*g* and 11*h*. The buckle is shown in FIGS. 2–4 in its tensioned position with the arms of bale 16 on one side of detents 20*a* and 20*b*. To release the buckle, the frame is moved as indicated by arrow 24 to the position indicated in FIG. 5, the arms of the bale riding resiliently over the detents to the opposite side thereof.

A finger grip is provided by widened end flanges 22*a* and 22*b* formed on the extreme end of the central piece 11*a* of frame 11.

While the invention has been described and illustrated in detail, it is to be clearly understood that this is intended by way of illustration and example only and is not to be taken by way of limitation, the spirit and scope of the invention being limited only by the terms of the following claims:

I claim:

1. A buckle assembly for tightening and securing a pair of straps or the like around a load to be retained in place comprising:

a frame member having a generally elongated flat central piece and a pair of opposing legs which extend normally from opposite edges of said central piece, said legs having oppositely positioned apertures formed therein towards one end thereof and detents or protrusions extending outwardly from said legs at a position therealong between said apertures and said one end thereof, and a resilient generally U-shaped bale member having turned in end portions, said end portions being fitting into the apertures of the frame legs to pivotally support the bale member thereon, one of said straps being fixedly retained on the bale member, the other of said straps being retained on the central piece of the frame member for adjustment relative thereto, the frame member being moveable between a "tension" position with the bale on one side of said detents and a "release" position with the bale on the other side of said detents.

2. The buckle of claim 1 wherein ramps are formed in the legs of said frame member directly adjacent to the apertures thereof to facilitate the installation of the end portions of the bale member in the apertures.

3. The buckle of claim 1 and further including a pair of widened end flanges forming a finger grip on the end of said frame member opposite to that towards which the bale member is mounted.

4. A buckle of claim 1 wherein the central piece has a pair of slots formed therein through which the other of said straps is reaved.

* * * * *